United States Patent [19]

Smith

[11] 3,938,836

[45] Feb. 17, 1976

[54] HIGH STRENGTH BOLT ASSEMBLY FOR DOORS AND THE LIKE

[76] Inventor: Donald V. Smith, Northern Nevada Childrens Home, Carson City, Nev. 89701

[22] Filed: July 12, 1974

[21] Appl. No.: 487,997

[52] U.S. Cl. ..... 292/148
[51] Int. Cl.[2] ..... E05C 1/04
[58] Field of Search ..... 292/148, 104, 205, 302

[56] References Cited

UNITED STATES PATENTS

| | | | |
|---|---|---|---|
| 1,317,092 | 9/1919 | Maurer et al. | 292/148 |
| 1,594,084 | 7/1926 | Weymann | 292/302 |
| 2,358,914 | 9/1944 | Dray | 292/148 |
| 2,613,970 | 10/1952 | Holmsten | 292/148 |
| 3,094,861 | 6/1963 | Sayles | 70/95 |

*Primary Examiner*—Robert L. Wolfe
*Attorney, Agent, or Firm*—Warren, Chickering & Gruenewald

[57] ABSTRACT

A high strength bolt assembly for positive securement of doors and the like is disclosed. The assembly includes a pair of mounting elements adapted for mounting to a door and door frame, and a slide bolt mounted to one of the elements for sliding movement to and from a bolted position engaging the remaining element. The mounting elements include flange portions and the flange portions and the slide bolt are each formed with openings therethrough positioned to enable padlocking of the flanges and bolt together as a unit. The mounting elements further are preferably formed for access to the padlock locking the bolt assembly from either side of the door. In one embodiment the flanges are provided on each of the mounting elements and extend toward each other to overlap in side-by-side relation. In another embodiment, particularly well suited for sliding glass doors, the flanges are provided on a single mounting element.

5 Claims, 5 Drawing Figures

HIGH STRENGTH BOLT ASSEMBLY FOR DOORS AND THE LIKE

BACKGROUND OF THE INVENTION

In recent years there has been a steadily increasing need for security for one's property and person. The instance of burglaries and forced entries into homes, office buildings, schools, industrial areas and other structures has steadily increased. One approach to this problem has been through the development of a multitude of alarm or warning systems, but law enforcement authorities constantly point to the need for the use of more secure locks and lock mechanisms.

One type of lock mechanism which is regarded highly by law enforcement officials is the so-called "dead bolt." This type of lock has the advantage of requiring a key to open the same from the inside as well as the outside of the structure. Thus, if the door is provided with a dead bolt, a burglar cannot enter through a small opening and open a door from the inside to carry away large objects. One of the primary disadvantages, however, of a dead bolt lock mechanism is that it is somewhat difficult and costly to install. The average homeowner often is not willing to attempt to install a dead bolt and is further unwilling to pay the added cost for installation by a locksmith. Still further, a dead bolt is difficult to adapt for use in securing sliding glass doors of the type found in many modern homes.

Attempts have been made to utilize the relatively simple and inexpensive padlock as part of a locked latch or bolt mechanism. These approaches have ranged from the relatively simple padlocking together of members as shown in U.S. Pat. No. 1,201,940 to the relatively complex use of multiple padlocks, bolts and keeper bars, as shown in U.S. Pat. No. 3,094,861. Such simple systems suffer from the disadvantage of not being suitable for opening from both sides of the door, while the complex system has solved this problem at the expense of complexity and cost.

Accordingly, it is an object of the present invention to provide a high strength, lockable bolt assembly for a door, window or the like which is simple and inexpensive to construct and may be adapted to a wide variety of applications.

It is another object of the present invention to provide a high strength bolt assembly for positive securement of a door, window or the like which can be locked or unlocked from either side of the door on which it is mounted.

Still a further object of the present invention is to provide a high strength bolt assembly for doors and the like in which the strength of the bolt mounting elements, as well as the bolt, may be locked in place as a barrier against entry.

Still a further object of the present invention is to provide a high strength, lockable bolt assembly which is reliable, easy to operate and easy to install.

The lockable bolt assembly of the present invention has other objects and features of advantage, some of which are set forth in more detail in and will be apparent from the following description and accompanying drawing.

SUMMARY OF THE INVENTION

The high strength bolt assembly for positive securement of a door, window or the like includes, briefly, a pair of assembly mounting elements with a first of the elements being adapted for mounting to the door proximate a door frame and the second of the elements being adapted for mounting to the door frame proximate the first of the elements. A bolt, preferably a slide bolt, is mounted to one of the elements for movement to and from a bolted and an unbolted position. The improvement of the present invention includes adjacent flange portions on the mounting elements which define a bolt receiving slot. The flange portions and bolt are each formed with a channel therethrough dimensioned for receipt of lock means, preferably a padlock, with the channels being in aligned registry when the bolt is in the bolted position. In one form of the bolt assembly of the present invention the flanges protrude in a side-by-side overlapping orientation with the bolt passing therebetween so that the flanges and the bolt may all be locked together as a unit. The mounting elements are further formed to provide access to the lock from either side of the door. In another embodiment of the high strength bolt assembly of the present invention, a gravity-biased slide bolt particularly well suited for mounting to sliding glass doors or the like is provided.

DESCRIPTION OF THE PREFERRED EMBODIMENTS

Figure 1:
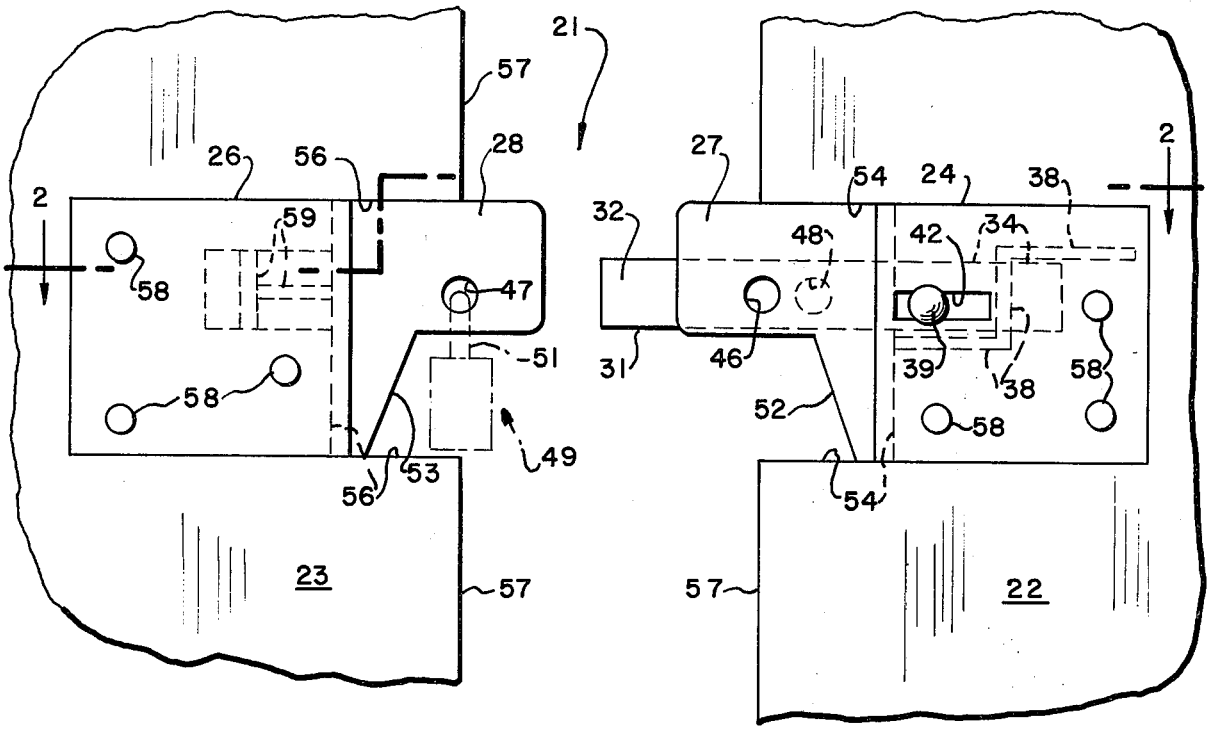
FIG. 1 is a fragmentary, side elevational view of a high strength bolt assembly constructed in accordance with the present invention.
Figure 2:
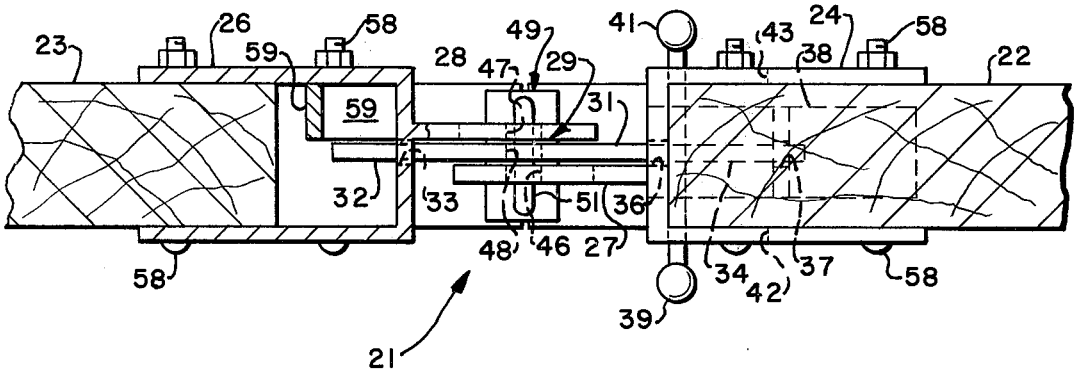
FIG. 2 is a fragmentary, top view in cross-section taken substantially along the plane of line 2—2 in FIG. 1.

Referring now to FIGS. 1 and 2, the bolt assembly, generally designated 21, is shown mounted on a pair of doors 22 and 23. As will be understood, the bolt assembly of the present invention can be mounted on swinging or sliding doors, windows, and similar closure means for various openings. As used herein, the word "door" shall include windows and other closure means. Moreover, while bolt assembly 21 is shown mounted to a pair of doors, either of door 23 or 22 can be a stationary door frame which defines the opening in which the door is mounted. Accordingly, the expression "door frame" shall include frames for doors and windows as well as a second door or window which itself can be opened or closed.

Bolt assembly 21 includes a first assembly mounting element 24 formed for and mounted to door 22 and a second assembly mounting element 26 formed for and mounted to second door, or what may be considered in reference to door 22 as a door frame 23, proximate the first assembly mounting element. As best may be seen in FIG. 2, mounting elements 24 and 26 preferably have generally U-shaped bodies from which flange portions 27 and 28 protrude. In the form of the invention shown in FIGS. 1 and 2, flange portions 27 and 28 can be seen in FIG. 2 to protrude from the corresponding assembly mounting elements to a side-by-side overlapping relationship which defines a slot 29 into which slide bolt 31 projects. Slide bolt 31 is preferably mounted to one of the assembly mounting elements, in this case element 24, for movement to and from a bolted position, as shown in FIG. 2. In the bolted position the end 32 of the bolt projects in through a slot 33 in mounting element 36 so as to bolt the two mounting elements together. The inner end 34 of slide bolt 31 passes through a slot 36 in U-shaped mounting element 24 and through a second vertically extending slot 37 in support member or portion 38. As will be seen from FIG. 2, end 34 of slide bolt 31 is retained in slot 37 of member 38, even when the bolt is reciprocated to the fully bolted position of FIG. 2. It is preferable for manipulation of the slide bolt that manually engageable handles 39 and 41 be provided and extend through slots 42 and 43 in the side walls of mounting element 24 for bolting and unbolting of the assembly from either side of door 22. When door 22 and 23 are mounted as swinging doors, the unbolted position is reached when end 32 clears slot 33 in the mounting member 26, since the doors are free for articulated movement at this point. The slide bolt, as shown in FIGS. 1 and 2, will secure the doors against pivotal or swinging movement when the bolt is in the bolted position, regardless of whether or not the bolt is locked in the bolted position. Positive securement of the bolt assembly in the bolted position is, however, the central aspect of the present invention.

In order to provide a positive securement of the bolt assembly in the bolted position, flange portions 27 and 28 are formed with channels 46 and 47, and slide bolt 31 is formed with channel 48, with each of the channels being dimensioned for receipt of lock means therein, in this case the locking shackle 51 of padlock 49. The channels 46, 47 and 48 are positioned respectively in the flanges and the slide bolt for aligned registration of the channels upon closing of the door and sliding of the bolt to the bolted position of FIG. 2. The combined thickness of the flange portions and slide bolt proximate the channels is thin enough to enable shackle 51 of padlock 49 to be passed through the channels to lock the flanges and slide bolt together as a high strength unit.

In many installations it is highly desirable to be able to lock or unlock the bolt assembly of the present invention from either side of doors 22 and 23. In order to accommodate securement of the bolt assembly from either side of the doors, it is preferable that the flanges 27 and 28 of the mounting elements be formed with notches 52 and 53 which define therebetween an opening extending transversely between the door and door frame, in this case between the pair of doors. The opening defined by notches 52 and 53 is dimensioned for mounting of padlock 49 therein when the padlock is in the locked position and is dimensioned to provide access to the padlock from both sides of the doors, as best may be seen in FIG. 2. The user may, therefore, use either of handles 39 or 41 to reciprocate the slide bolt to the bolted position and lock the bolt and flanges together by inserting shackle 51 of the padlock through the aligned channels or openings, with the padlock hanging down below the slide bolt in the opening defined by notches 52 and 53. Conversely, the padlock is accessible from either side of the door and may be tilted in either direction to expose the key receiving slot. If desired, the opening defined by notches 52 and 53 can be covered by a flexible fabric shield or flap (not shown), which could be lifted or displaced away from the bolt assembly to expose the assembly for locking and unlocking an yet prevent the passage of air through the opening defined by notches 52 and 53.

As best may be seen in FIG. 1, it is preferable that first and second mounting elements 24 and 26 be mounted in recesses or notches 54 and 56 which are formed in the door and door frame. This construction allows flanges 27 and 28 to overlap a substantial portion of each other and enables the opening defined by notches 52 and 53 in the flanges to be centered over the slot defined by the edges 57 of the door and door frame. As will be understood, there may be installations in which it is advantageous to provide a notch only in the door or only in the door frame instead of recesses 54 and 56 of substantially equal depth in both the door and door frame. Additionally, it is not always necessary or desirable to provide for locking and unlocking from both sides of the door, and in such instances the recesses 54 and 56 can be substantially eliminated, with the flanges being formed to overlap on one side of the door rather than at about the midpoint in the thickness of the door.

Mounting elements 24 and 26 are shown fastened to doors 22 and 23 by means of carriage bolts 58 which pass through the door and the U-shaped bodies of the mounting elements. It is preferable that the smooth heads of the bolts 58 face outwardly of the structure so as to prevent unbolting from the outside of the structure. Additionally, the nuts on the inside may be welded or otherwise secured against removal. It should be noted, however, that padlocking of the flanges and slide bolt together as a unit when combined with mounting of the bolt assembly and recesses in the door and door frame produces a unit that would be most difficult and tedious to attempt to remove, even if the carriage bolts could be removed.

The overall strength of the bolt assembly of the present invention is further enhanced by means of supporting member or portion 38, which is adapted and positioned to engage and support the inner end 34 of slide bolt 31, and T-shaped supporting member or portion 59, which supports the opposite end 32 of the slide bolt against bending moments which might result in the event that the doors were attempted to be forced open. Thus, the slide bolt is not only supported in slots 33 and 36 against bending, but additionally is provided with supporting portions 59 and 38 which engage the ends and provide additional support against attempts to force the door.

Figure 3:
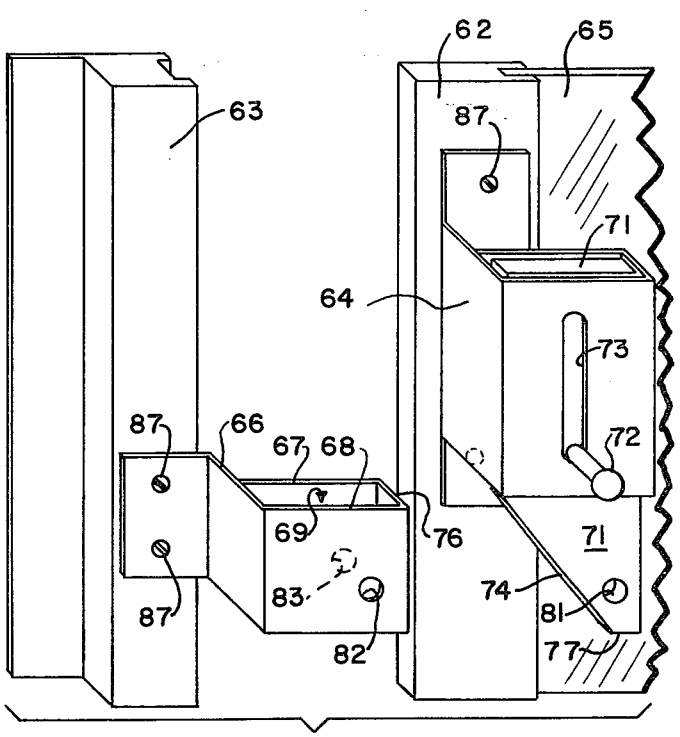
FIG. 3 is a fragmentary, top perspective view of an alternative embodiment of the bolt assembly of the present invention showing the door in an open position.
Figure 4:
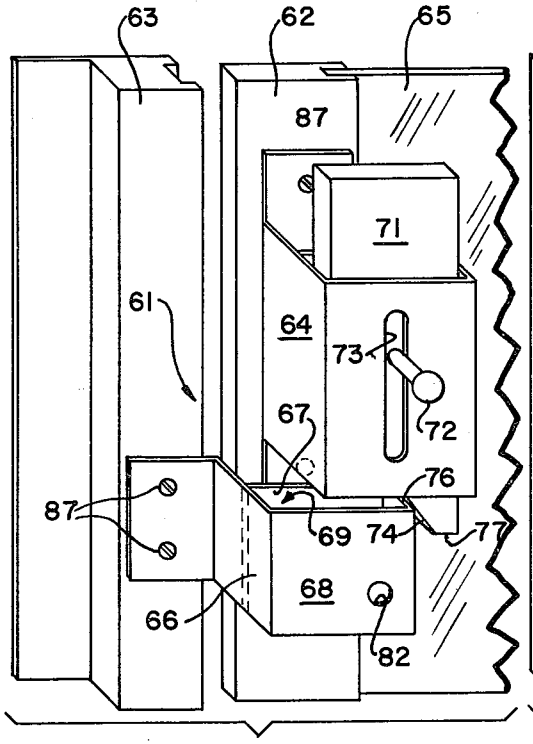
FIG. 4 is a fragmentary, top perspective view of the bolt assembly of FIG. 3 showing the door in a partially closed position.
Figure 5:
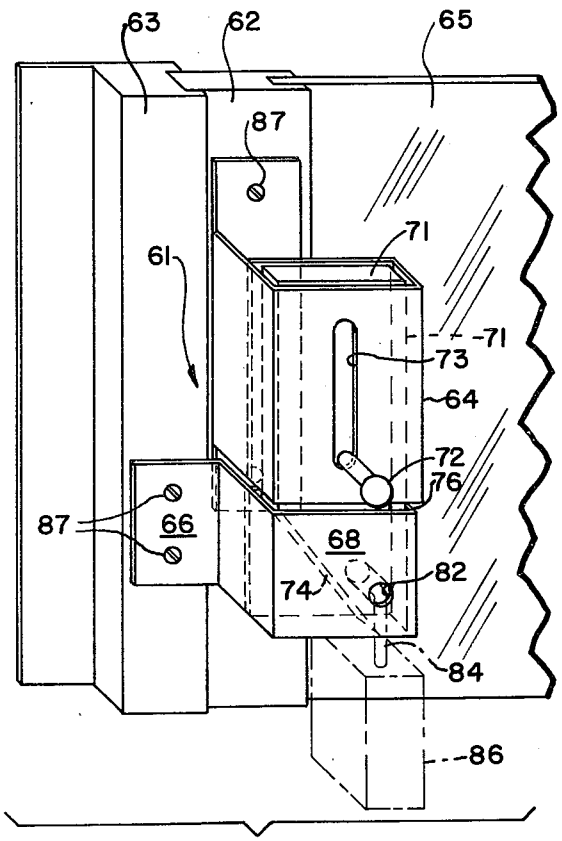
FIG. 5 is a fragmentary, top perspective view of the bolt assembly of FIG. 3 showing the door in a fully closed position.

Referring now to FIGS. 3, 4 and 5, an alternative embodiment of the bolt assembly of the present invention may be described. The bolt assembly, generally designated 61, may be seen to be mounted to sliding door 62 and door frame 63. In this case, the sliding door includes a glass pane 65 and is constructed in a conventional manner. Mounted to the stile of door 62 is assembly mounting element 64, while a second mounting element 66 is mounted to door frame 63 proximate, but in this case below, first mounting element 64. Second mounting element 66 is provided with a pair of side-by-side flange portions 67 and 68 which define slide bolt receiving slot 69 therebetween. Mounted to element 64 is slide bolt 71 having manually engageable handle 72 extending outwardly through slot 73 in the mounting element. As so mounted, slide bolt 71 is gravity biased to the downward position, which is the bolted position, as best may be seen in FIG. 5.

In order to provide for an automatic bolting of the assembly, slide bolt 71 is preferably formed with a tapered surface 74 which is adapted to slidably engage the edge 76 of mounting element 66 and thereby move bolt 71 against gravity from the bolted position to an unbolted position enabling the end 77 of the slide bolt to pass over edge 76 so that the bolt may enter slot 69. Thus, as door 62 is closed, edge 76 and tapered surface 74 causes bolt 71 to be progressively upwardly urged, as is shown in FIG. 4, until end 77 passes over the edge of the mounting element and enables slide bolt 71 to drop downwardly automatically under the influence of gravity to the bolted position of FIG. 5. The bolt assembly may be opened by engaging handle 72 and sliding the bolt upwardly, after which door 62 may be opened.

As was the case with the previously described embodiment of the bolt assembly of the present invention, slide bolt 71 is provided with an opening or channel 81 which is positioned to align with openings or channels 82 and 83 in flange portions 67 and 68, when the bolt is in the bolted position shown in FIG. 5. As so aligned, the shackle 84 of a padlock 86 may be passed through aligned openings 81, 82 and 83 to positively lock the assembly against opening.

The high strength bolt assembly of FIGS. 3, 4 and 5 may be easily installed by means of fasteners 87 to provide the homeowner with what would be the equivalent of a dead bolt for a sliding glass door. Thus, a burglar could not enter through the locked door, nor could he enter through another door and exit through door 62.

What is claimed is:

1. In a high strength bolt assembly for positive securement of a door, window or the like, said assembly including a pair of assembly mounting elements with a first of said elements being formed for mounting to said door proximate a door frame and a second of said elements being formed for mounting to said door frame proximate said first of said elements, and a bolt mounted to one of said elements for movement to and from a bolted position and an unbolted position, the improvement comprising:

said elements being formed to provide, as mounted on said door and door frame, adjacent flange portions defining a bolt receiving slot therebetween, said flange portions each spanning across the slot defined by the confronting edges of said door and said door frame when said door is in a closed position;

said bolt being mounted for movement into said bolt receiving slot upon movement to said bolted position and being mounted to span across the slot defined by the confronting edges of said door and said door frame in said bolted position; and said flange portions and said bolt each being formed with a channel therein dimensioned for receipt of lock means, and each said channel being positioned for aligned registration of all of the channels in a direction extending substantially parallel to the slot defined by the confronting edges of said door and door frame upon closing of said door and movement of said bolt to said bolted position, said elements being further formed and said channels oriented for positioning of said lock means therethrough for access to said lock and unlock the same from both sides of said door.

2. A high strength bolt assembly as defined in claim 1 wherein, said first element is formed with one of said flange portions and said second element is formed with the remainder of said flange portions, said flange portions protruding toward each other in a side-by-side overlapping relationship to define said bolt receiving slot therebetween and said flange portions being formed with notches therein below said channels dimensioned for receipt of a padlock having the shackle portion thereof passed through said channels.

3. In a high strength bolt assembly for positive securement of double doors or the like, said assembly including a pair of assembly mounting elements with a first of said elements being adapted for mounting to a first of said double doors proximate a second of said double doors and a second of said elements being formed for mounting to said second of said double doors proximate said first of said elements, and a slide bolt formed for mounting proximate said elements and formed for sliding movement to and from a bolted position and an unbolted position, the improvement comprising:

said elements each being formed with flange portions formed to extend toward and overlap each other and the slot defined by the confronting edges of said double doors when said elements are mounted to said double doors and said double doors are in a substantially closed position;

said slide bolt being formed to overlap the overlapped flange portions and span across between said elements when said double doors are in a substantially closed position and said slide bolt is in said bolted position; and said flange portions and said slide bolt each being formed with a channel therein dimensioned for receipt of lock means and positioned for aligned registration of all of the channels in a direction substantially perpendicular to said doors upon positioning of said double doors in a substantially closed position and sliding of said slide bolt to said bolted position, said elements and said slide bolt being further formed for cooperative securement of said double doors against a forced opening independently of lock means positioned in said channels.

4. A high strength bolt assembly as defined in claim 3 wherein, said slide bolt is mounted for sliding movement to said bolted position in a slot defined between said flange portions, and the channels in said slide bolt and said flange portions are formed and said slide bolt and said flange portions have a thickness proximate said channels enabling locking of said flange portions and said slide bolt together as a unit by means of a padlock, said flange portions being formed and said channels being oriented to extend through to both sides of said double doors for access to said padlock for passage of the shackle thereof through and removal of the shackle from said channels and locking and unlocking of said padlock from either side of said double doors.

5. A high strength bolt assembly as defined in claim 4 wherein, said first element and said second element each are formed with slide bolt supporting portions adapted and positioned to engage and support said slide bolt against bending moments resulting from attempts to force open said door.

* * * * *